US010203172B2

(12) United States Patent
Dechant

(10) Patent No.: US 10,203,172 B2
(45) Date of Patent: Feb. 12, 2019

(54) PISTOL WITH A ROTARY BARREL

(71) Applicant: Glock Technology GmbH, Deutsch-Wagram (AT)

(72) Inventor: Friedrich Dechant, Hollabrunn (AT)

(73) Assignee: Glock Technology GmbH, Deutsch Wagram (AT)

( * ) Notice: Subject to any disclaimer, the term of this patent is extended or adjusted under 35 U.S.C. 154(b) by 15 days.

(21) Appl. No.: 15/374,850

(22) Filed: Dec. 9, 2016

(65) Prior Publication Data

US 2017/0198993 A1 Jul. 13, 2017

(30) Foreign Application Priority Data

Dec. 10, 2015 (EP) ..... 15199414

(51) Int. Cl.

| | |
|---|---|
| ***F41A 3/16*** | (2006.01) |
| ***F41A 3/26*** | (2006.01) |
| ***F41A 5/06*** | (2006.01) |
| ***F41C 3/00*** | (2006.01) |

(52) U.S. Cl.
CPC *F41A 3/16* (2013.01); *F41A 3/26* (2013.01); *F41A 5/06* (2013.01); *F41C 3/00* (2013.01)

(58) Field of Classification Search
CPC ..... F41A 3/15; F41C 3/00
See application file for complete search history.

(56) References Cited

U.S. PATENT DOCUMENTS

| | | | | |
|---|---|---|---|---|
| 1,427,966 | A | 9/1922 | Nickl | |
| 1,637,400 | A * | 8/1927 | Josef Lovasz | F41A 3/12 89/145 |
| 2,107,359 | A | 2/1938 | Altenburger | |
| 2,817,174 | A | 12/1957 | Liedke | |
| 3,745,881 | A | 7/1973 | Roy | |
| 4,539,889 | A | 9/1985 | Glock | |
| 4,825,744 | A | 5/1989 | Glock | |
| 4,893,546 | A | 1/1990 | Glock | |

(Continued)

FOREIGN PATENT DOCUMENTS

| | | |
|---|---|---|
| DE | 459454 C | 5/1928 |
| DE | 478630 C | 6/1929 |
| EP | D359715 A2 | 3/1990 |

OTHER PUBLICATIONS

Beretta PX4 Storm review on YouTube at https://youtu.be/wrd2mjVFNoM, published Sep. 13, 2015.

(Continued)

*Primary Examiner* — Joshua E Freeman

(74) *Attorney, Agent, or Firm* — Kolisch Hartwell, P.C.

(57) ABSTRACT

A pistol with a frame, a slide which is movable thereon and a rotary barrel which is located in the slide. The rotary barrel is rotated and moved axially with respect to the slide between a locked position and an open position by means of cams and grooves. In order to avoid the wear which is customary in weapons of this type, the slide is provided with a stop surface running obliquely with respect to the bore axis, and the barrel has a corresponding contact surface. During the locking by the flat contact between said surfaces, the beginning of the relative rotational movement is initiated. By virtue of this precisely guided and directed interaction, wear can be reduced by orders of magnitude relative to the prior art.

11 Claims, 15 Drawing Sheets

(56) References Cited

U.S. PATENT DOCUMENTS 4,984,504 A * 1/1991 Beretta ..... F41A 5/06 89/163
5,050,481 A * 9/1991 Knight, Jr. ..... F41A 5/06 42/69.02
5,585,589 A * 12/1996 Leiter ..... F41A 3/54 42/75.1
5,649,383 A 7/1997 Wesp et al.
6,234,059 B1 * 5/2001 Fuchs ..... F41A 3/66 89/195
6,314,859 B1 * 11/2001 Weichert ..... F41A 3/86 42/1.06
7,103,998 B2 * 9/2006 McGarry ..... F41A 3/86 42/16
7,823,314 B1 11/2010 Wheatley
8,061,255 B1 * 11/2011 Boberg ..... F41A 9/23 42/16
8,807,010 B2 8/2014 Bubits
8,950,100 B2 2/2015 Nebeker et al.
9,568,262 B2 2/2017 Bantle et al.
2009/0199450 A1 * 8/2009 Storch ..... F41A 9/28 42/66
2010/0275491 A1 * 11/2010 Leiter ..... F41A 21/26 42/76.01
2012/0085225 A1 * 4/2012 Vanek ..... F41A 5/06 89/163
2014/0196337 A1 * 7/2014 Bandini ..... F41A 3/44 42/16
2016/0316336 A1 * 10/2016 Krenz ..... G09B 19/003
2017/0191784 A1 7/2017 Kroger

OTHER PUBLICATIONS

Grand Power X-Calibur—Competition Ready 9mm review on YouTube at https://youtu.be/DOvDmZVOunM, published Oct. 8, 2015.

* cited by examiner

PISTOL WITH A ROTARY BARREL

TECHNICAL FIELD

The invention relates to a pistol with a rotary barrel according to the preamble of claim 1.

BACKGROUND

Pistols with a rotary barrel are known per se but are not very widespread. Firstly, they are considered as shooting particularly quietly and are therefore desirable since the barrel carries out a movement only about its axis or the bore axis, whereas, for example in the case of drop barrel pistols, the center of gravity of the barrel carries out a vertical movement to which a rotational movement about a transverse axis of the weapon is also added, which makes the weapon noisy per se. Since, however, on the other hand, in the case of the rotary barrel, the components necessary for carrying out and limiting the rotational movement are subjected to extremely hard stresses and experience a high degree of wear, which in practice time and again leads to problems in the reliability of such weapons, pistols with a rotary barrel have not really taken off.

As an example of pistols with a rotary barrel, reference is made to EP 359 715, corresponding to U.S. Pat. No. 4,984,504, the content of said US document is incorporated by reference into the content of the present application for jurisdictions in which this is possible. According to these documents, the rotational movement of the barrel is brought about by a correspondingly contoured block which is inserted around the restoring spring in the handle piece. Apart from the complicated production and the not entirely straightforward installation and removal, the high dynamic shock-type forces which are to be transmitted upon each shot are not introduced into the handle part directly, but rather via said block, as a result of which great problems relating to the wear and the accuracy of the movement occur.

A weapon of this type can also be found on the internet at www.bing.com/videos with a date of 13 Sep. 2015 by searching the keywords 'beretta,' 'px4,' and 'storm,' or found in the EPO library under XP054976549, and also an identical or similar weapon under XP054976552, or on the internet at www.youtu.be/DOvDmZVOunM.

A firearm which is entirely separate in many details from 1924, which, although it does not have a rotary barrel, does contain a rotatable breech, is known from DE 459 454 and its additional patent corresponding to DE 478 630, overall corresponding to U.S. Pat. No. 1,637,400. The content of said US document is incorporated by reference into the content of the present application for jurisdictions in which this is possible. The weapon disclosed there has a barrel which is movable rectilinearly for a short distance along its axis and moves to the rear together with the carriage and the breech after discharging a shot. Upon reaching its end position, the barrel imparts an additional impulse via a lever to the carriage and therefore accelerates the latter beyond the speed of the breech. At the same time, a control surface of the carriage also comes into contact with a projection of the breech, rotates said projection, as a result of which the form-fitting locking thereof with the barrel is released and the breech moves further rearwards together with the carriage, as a result of which the chamber is finally opened. The necessary correct sequence of the movements requires an accuracy in production which even today cannot be achieved in an economically expedient manner, and there is no mention at all of problems with wear and the risk of soiling and the problematic maintenance. Whether this weapon has ever been provided in practice is unclear.

U.S. Pat. No. 1,427,966 from 1921, the content of said US document is incorporated by reference into the content of the present application for jurisdictions in which this is possible, going back to four German applications from 1915, describes kinematics which are inverse thereto and in which, for the unlocking-locking of the connection between barrel and breech, the barrel is rotated and this is undertaken by means of contact surfaces firstly on the barrel and secondly on the handle part. The same problems as in the previously mentioned construction therefore occur. This weapon has never taken off in practice.

In contrast thereto, pistols with a drop barrel are widespread a million times; in this connection, reference is made, for example, to U.S. Pat. No. 4,539,889, U.S. Pat. No. 4,825,744 and U.S. Pat. No. 4,893,546 which describe such weapons in detail. The content of said documents is incorporated by reference into the content of the present application for jurisdictions in which this is possible.

There is therefore a need to provide a pistol with a rotary barrel that does not have the disadvantages mentioned, but rather is as robust as a pistol with a drop barrel and nevertheless has the advantages associated with the rotary barrel.

It is an aim of the invention to specify such a weapon.

SUMMARY

According to the invention, these aims are achieved by a weapon which has the features specified in the characterizing part of claim 1. In other words, the barrel is guided in a form-fitting manner both in its longitudinal movement along the bore axis and in its rotational movement about the bore axis over the entire length of the movement, and it is particularly important that, during the engagement, the beginning of the rotational movement of the barrel is brought about by the interaction of control surfaces on barrel and carriage. By means of this permanent and positive guidance, the mechanical stability which has been lacking in weapons of this type in the prior art is achieved.

BRIEF DESCRIPTION OF THE DRAWINGS

The invention is explained in more detail below with reference to the drawings, which depict an exemplary embodiment:

FIG. 1A shows the starting position in a schematic bottom view of the slide (or carriage) with parts of the frame, FIG. 1B shows a side view of the slide, FIG. 1C shows a top view with viewing windows cut out, and FIG. 1D shows a section view normal to the bore axis as indicated in FIG. 1B.

FIG. 2A shows a schematic bottom view of the slide with parts of the frame, FIG. 2B shows a side view of the slide, FIG. 2C shows a top view with viewing windows cut out, and FIG. 2D shows a section view normal to the bore axis as indicated in FIG. 2B.

FIG. 3A shows a schematic bottom view of the slide with parts of the frame, FIG. 3B shows a side view of the slide, FIG. 3C shows a top view with viewing windows cut out, and FIG. 3D shows a section view normal to the bore axis as indicated in FIG. 3B.

FIG. 4A shows a schematic bottom view of the slide with parts of the frame, FIG. 4B shows a side view of the slide, FIG. 4C shows a top view with viewing windows cut out, and FIG. 4D shows a section view normal to the bore axis as indicated in FIG. 4B.

FIG. 5A shows a schematic bottom view of the slide with parts of the frame, FIG. 5B shows a side view of the slide, FIG. 5C shows a top view with viewing windows cut out, and FIG. 5D shows a section view normal to the bore axis as indicated in FIG. 5B.

FIG. 6A shows a schematic bottom view of the slide with parts of the frame, FIG. 6B shows a side view of the slide, FIG. 6C shows a top view with viewing windows cut out, and FIG. 6D shows a section view normal to the bore axis as indicated in FIG. 6B.

FIG. 7A shows a schematic bottom view of the slide with parts of the frame, FIG. 7B shows a side view of the slide, FIG. 7C shows a top view with viewing windows cut out, and FIG. 7D shows a section view normal to the bore axis as indicated in FIG. 7B.

FIG. 8A shows a schematic bottom view of the slide with parts of the frame, FIG. 8B shows a side view of the slide, FIG. 8C shows a top view with viewing windows cut out, and FIG. 8D shows a section view normal to the bore axis as indicated in FIG. 8B.

FIG. 9A shows a schematic bottom view of the slide with parts of the frame, FIG. 9B shows a side view of the slide, FIG. 9C shows a top view with viewing windows cut out, and FIG. 9D shows a section view normal to the bore axis as indicated in FIG. 9B.

FIG. 10A shows a schematic bottom view of the slide with parts of the frame, FIG. 10B shows a side view of the slide, FIG. 10C shows a top view with viewing windows cut out, and FIG. 10D shows a section view normal to the bore axis as indicated in FIG. 10B.

FIG. 10A shows a schematic bottom view of the slide with parts of the frame, FIG. 10B shows a side view of the slide, FIG. 10C shows a top view with viewing windows cut out, and FIG. 10D shows a section view normal to the bore axis as indicated in FIG. 10B.

FIG. 12A shows a side view of the assembly. FIG. 12B shows a top view of the assembly. FIG. 12C shows an oblique view of the assembly.

FIG. 13A shows a side view of the assembly. FIG. 13B shows a top view of the assembly. FIG. 13C shows an oblique view of the assembly.

FIG. 14A shows a side view of the assembly. FIG. 14B shows a top view of the assembly. FIG. 14C shows an oblique view of the assembly.

FIG. 15A shows a top view of the pistol. FIG. 15B shows a section through the center plane of the pistol.

DETAILED DESCRIPTION

In the description and the claims, the terms "front", "rear", "top", "bottom" and so on are used in the general form and with reference to a pistol which is held in the customary manner. That is to say that the muzzle of the barrel is at the "front", that the slide or carriage is moved to the "rear" by the explosion gases, etc.

Figure 15A:
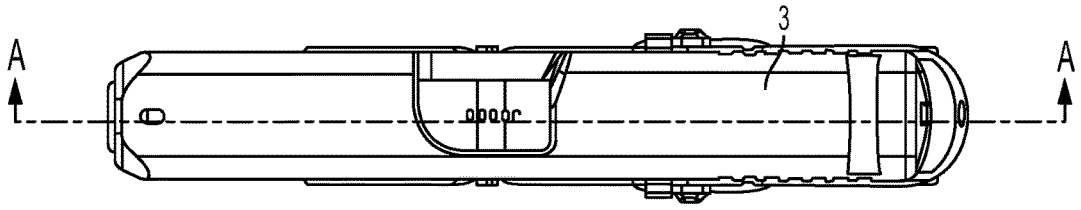
FIGS. 15A and 15B depict a pistol according to the invention as a whole.
Figure 15B:
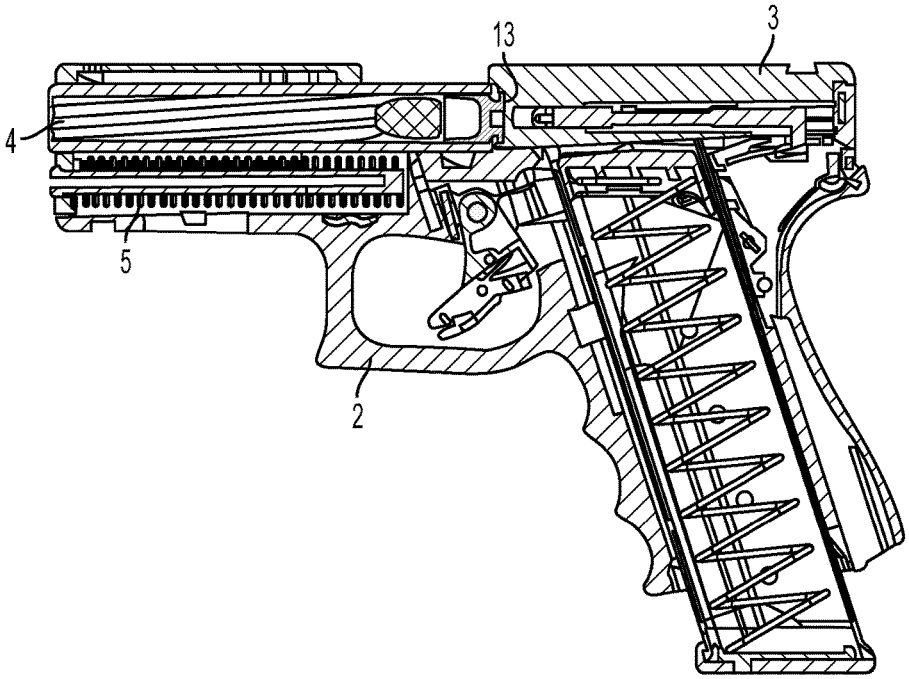

FIG. 15 shows, for orientation purposes, a pistol according to the invention in a top view (15*a*) and, schematically, in the section through the plane of symmetry (15*b*). The term "plane of symmetry" should be understood here in technical terms and not mathematical terms since various components are not formed symmetrically to said plane, but the essential components are as is the entire appearance.

A weapon 1 has a frame 2 which, in integral or constructed form, also comprises a handle in which a magazine is inserted. The illustration of the magazine spring shows that the section is undertaken schematically and not strictly geometrically. A striking pin is illustrated in the slide 3 and a trigger mechanism in the frame 2. This is all prior art and does not require any further explanation. A barrel 4 is mounted in the slide (carriage) 3, as will be described below.

FIG. 1 shows the situation immediately before the shot is discharged. FIG. 1*a* is a bottom view of barrel 4 and slide with that part of the frame 2 which bears a control groove 9: the slide 3 in which the striking pin together with (a) possible safety catch(es) and retaining mechanism, as customary in the prior art, is provided, is provided in a longitudinally movable manner on the frame 2, the frame 2 bears the slide 3 with the barrel 4 and the restoring spring 5 and other components, as is likewise known from the prior art. Reference is made in this connection to the documents mentioned at the beginning and to FIG. 15.

Figure 1A:
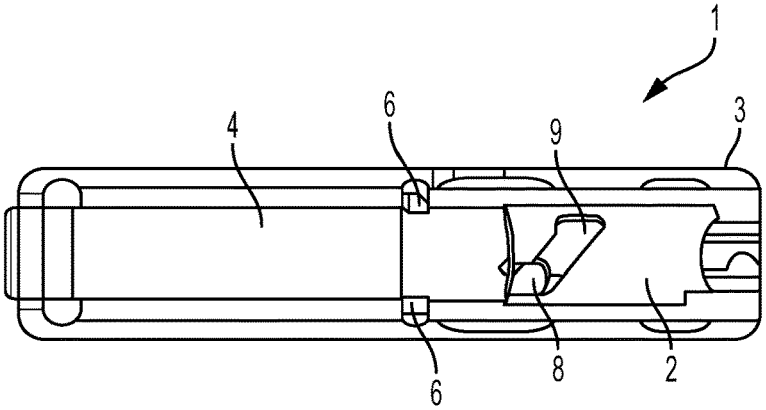
FIGS. 1A-1D depict the starting position of an exemplary embodiment.
Figure 1B:
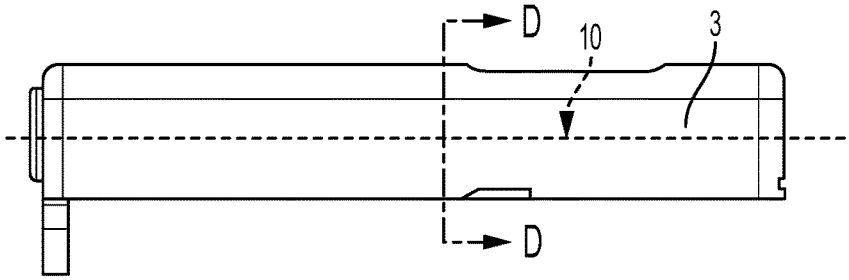
Figure 1C:
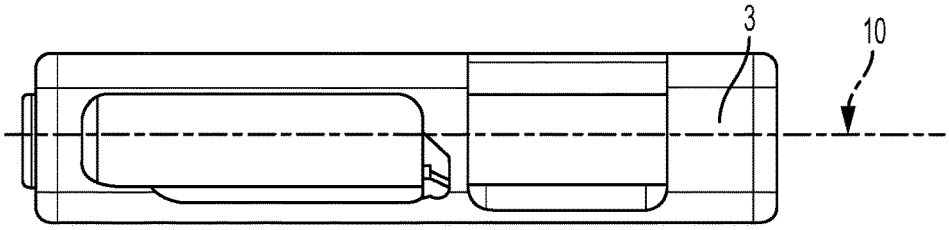
Figure 1D:
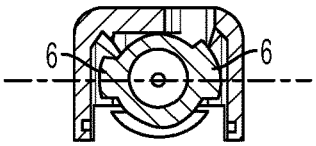
Figure 2A:
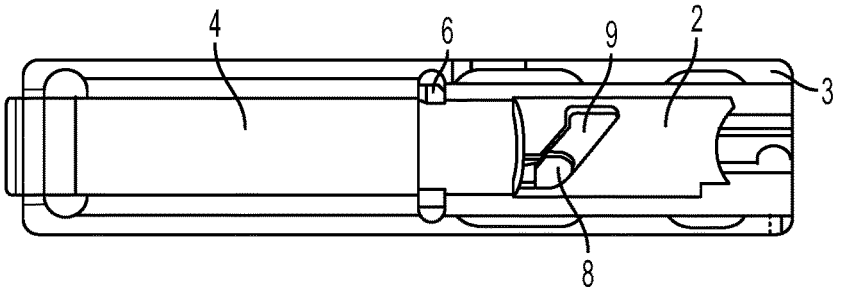
FIGS. 2A-2D depict the first phase of the barrel recoil for the embodiment of FIGS. 1A-1D.
Figure 2B:
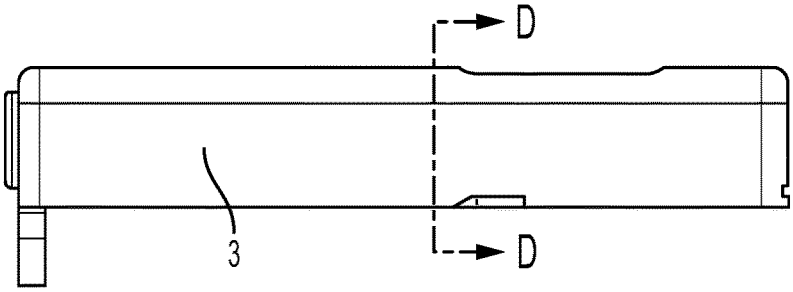
Figure 2C:
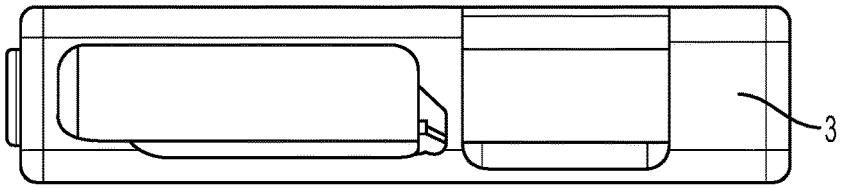
Figure 2D:
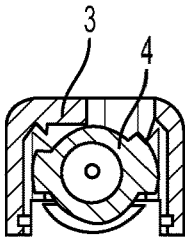
Figure 3A:
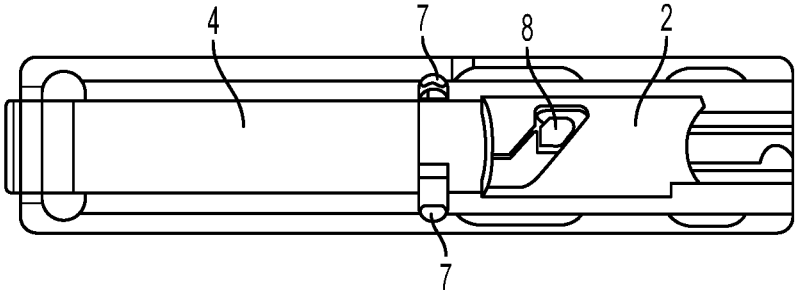
FIGS. 3A-3D depict the barrel recoil with rotation of the barrel for the embodiment of FIGS. 1A-1D.
Figure 3B:
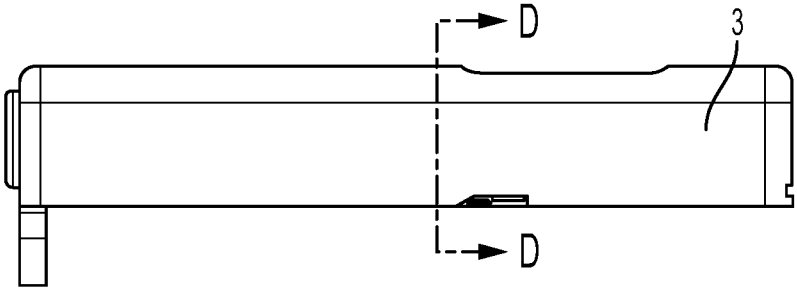
Figure 3C:
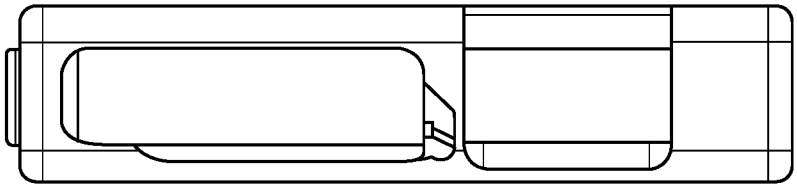
Figure 3D:
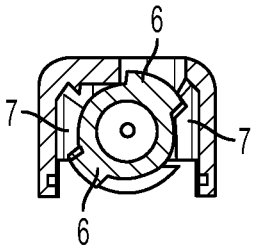

The following geometrical and therefore also dynamic characteristic features (can also be readily seen perspectively in FIGS. 12-14), by means of which the aims according to the invention are achieved, are now provided between the barrel 4 and the slide 3 or the frame 2: in the exemplary embodiment illustrated, the barrel 4 has two locking studs 6 which are formed in a projecting manner in the radial direction and, in the locked state, as FIG. 1 shows, protrude into locking grooves 7 (FIG. 3*d*) of the slide 3 and are thus fixed in the axial direction, which also fixes the barrel in the axial direction with respect to the slide. Said locking studs are formed differently from one another as is apparent from the reasons explained further below and from the illustrations d), but this does not affect the effectiveness of the two studs in respect of the axial fixing of the barrel.

In "axial direction" should be understood as meaning the direction of the barrel axis or bore axis 10 that should be regarded as defined by the frame for the purposes of the description.

Furthermore, the barrel 4 has a control stud 8 which protrudes into a control groove 9 of the frame 2 (not of the slide 3!). Said control groove 9 has an oblique central region, the one end of which, the front end, is adjoined by a locking region which projects in the axial direction and in which the control stud 8 is located in the position shown in FIG. 1. The control stud 8 can be displaced in the locking region for a small distance in the direction of the bore axis 10. At the other end, the rear end, the control groove 9 has a retaining region, the function of which will be explained further below. It will merely be pointed out here that the retaining region has formed a retaining surface 17 (FIG. 2) running normally to the bore axis 10 at the front.

As a comparison of FIG. 1 with FIG. 2 directly shows, the latter illustrating the situation shortly after the shot has been discharged and therefore shortly after the illustration shown in FIG. 1, slide 3 and barrel 4 move together, without a relative movement with respect to each other, for a short distance, in the region of a length of 1-3 mm, to the rear in the direction of the bore axis 10, and therefore and barrel reliably remain closed until the projectile has left the barrel 4. This joint movement of slide and barrel on the frame ends without rotation when the rear surface of the control stud 8 arrives at the rear end of the locking region of the control groove 9, as illustrated in FIG. 2. The comparison of FIG. 1*d* with FIG. 2*d* furthermore shows that the angular position of the barrel 4 about the bore axis 10 remains unchanged at this time. The rear wall of the control stud 8 has the same inclination here with respect to the bore axis 10 as the contour of the control groove 9, and therefore a flat contact occurs that is capable of withstanding the shock-type forces to the best possible extent.

FIG. 3, shortly following on in time from FIG. 2, now shows the rotational movement which the control groove 9 in the frame 2 forces on the barrel 4 via the control stud 8 over the course of the joint rearward movement of the slide together with the barrel. This can clearly be seen in the section in FIG. 3*d*, the locking studs 6 have already passed entirely out of the locking grooves 7 of the slide, and barrel 4 and slide 3 are no longer connected in the axial direction.

Figure 4A:
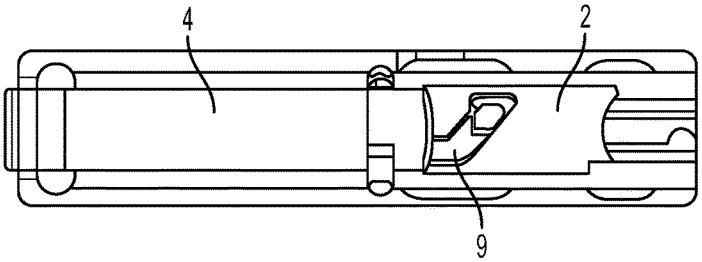
FIGS. 4A-4D depict the free rotation for the embodiment of FIGS. 1A-1D.
Figure 4B:
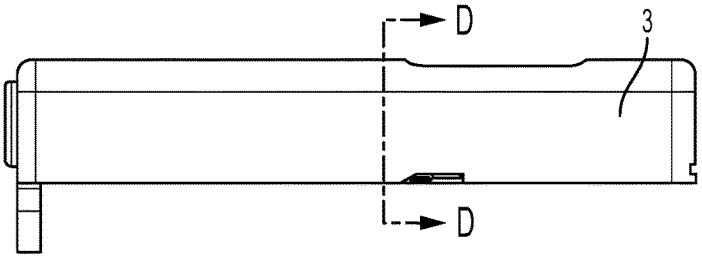
Figure 4C:
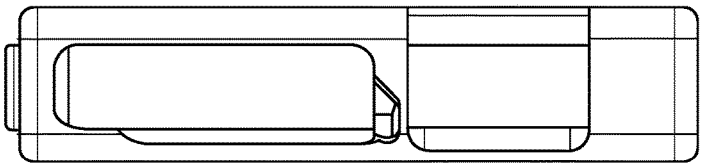
Figure 4D:
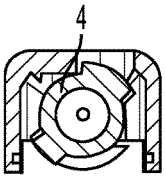
Figure 4E:
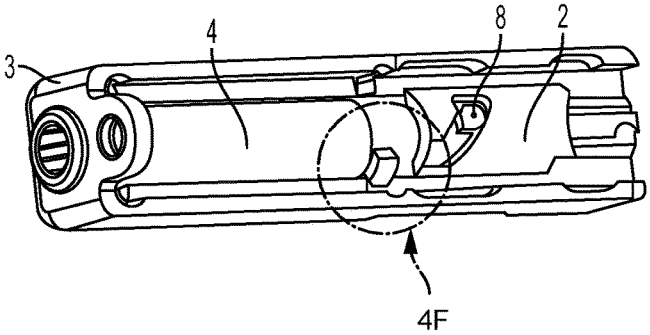
FIG. 4E shows a perspective view obliquely from below.
Figure 4F:
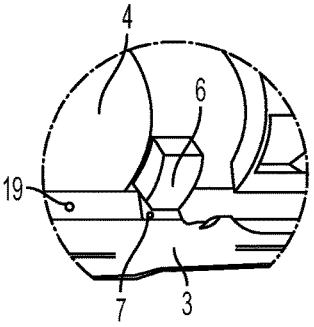
FIG. 4F shows the detail 4F indicated in FIG. 4E in an enlarged illustration.

This situation can readily be seen in FIGS. 4*e* and 4*f* in a perspective view and an enlarged detail. By means of this rotational movement to the extent shown, the axial connection between slide 3 and barrel 4 is canceled.

Figure 5A:
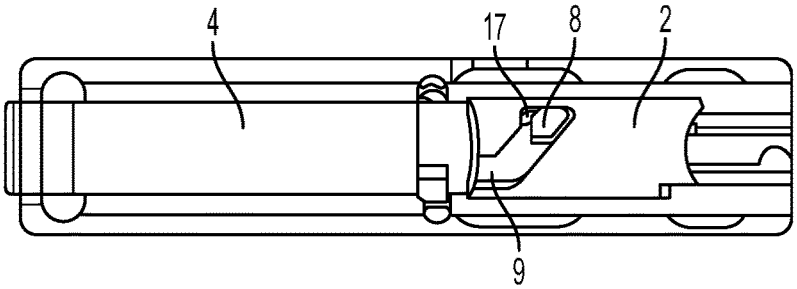
FIGS. 5A-5D depict the ultimately completely unlocked position for the embodiment of FIGS. 1A-1D.
Figure 5B:
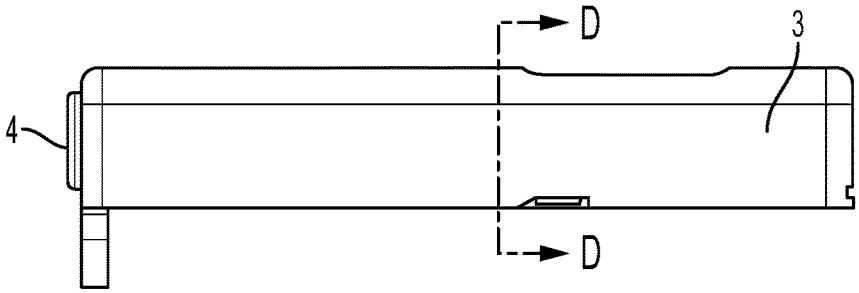
Figure 5C:
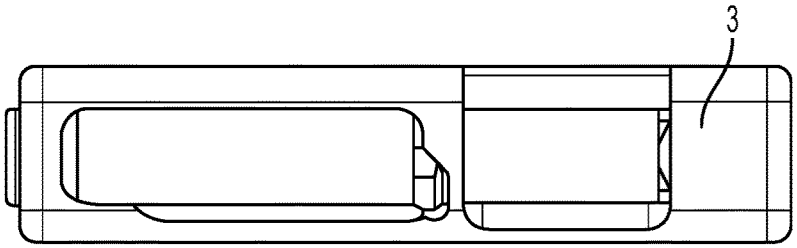
Figure 5D:
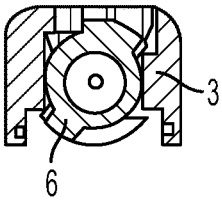
Figure 6A:
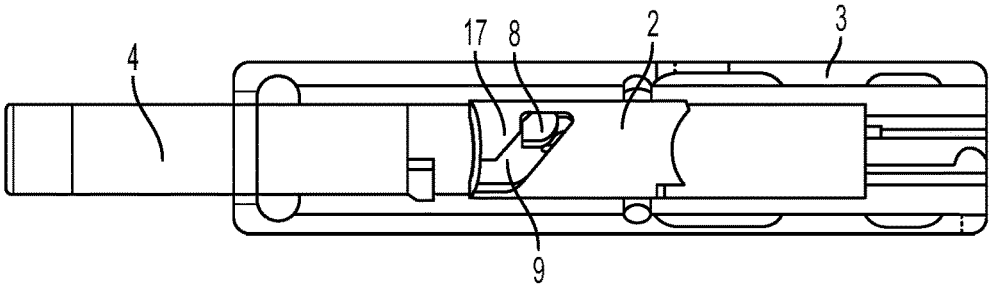
FIGS. 6A-6D depict the situation of the barrel in an axial end position at the end of the barrel recoil for the embodiment of FIGS. 1A-1D.
Figure 6B:
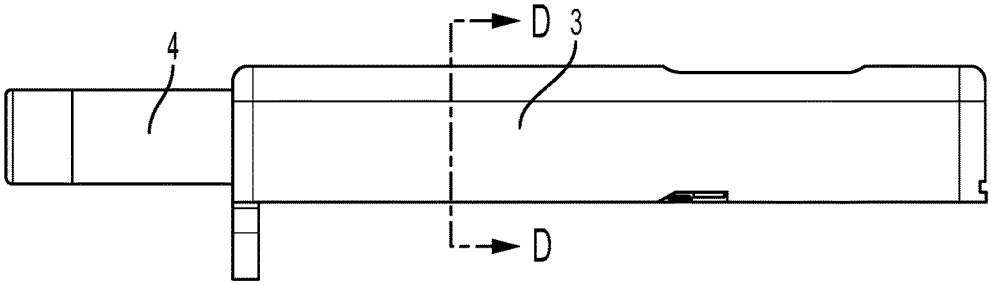
Figure 6C:
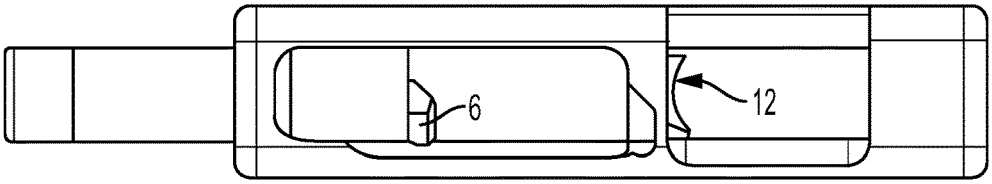
Figure 6D:
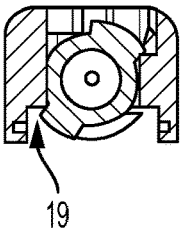
Figure 7A:
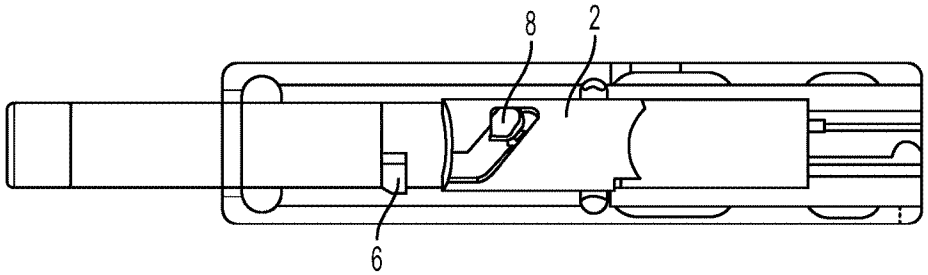
FIGS. 7A-7D depict the beginning of the forward motion of the barrel for the embodiment of FIGS. 1A-1D.
Figure 7B:
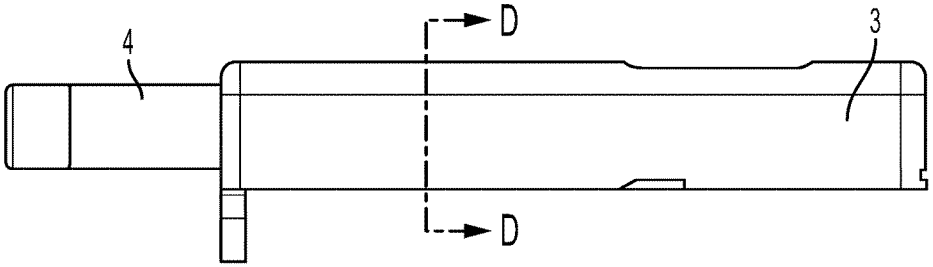
Figure 7C:
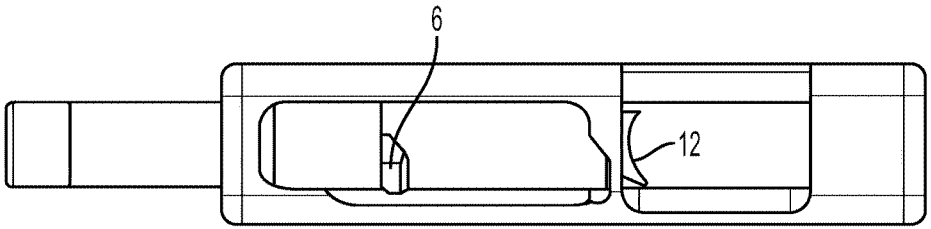
Figure 7D:
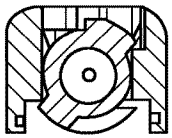
Figure 8A:
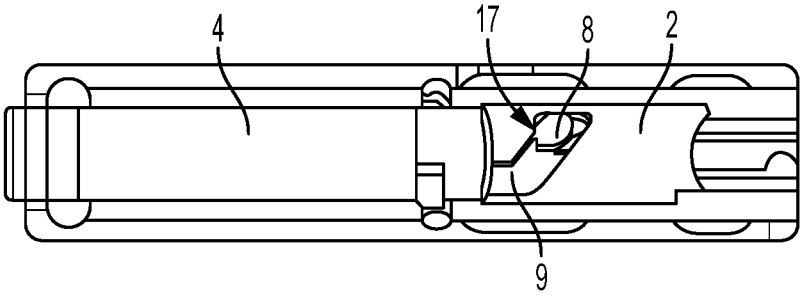
FIGS. 8A-8D depict the beginning of the engagement for the embodiment of FIGS. 1A-1D.
Figure 8B:
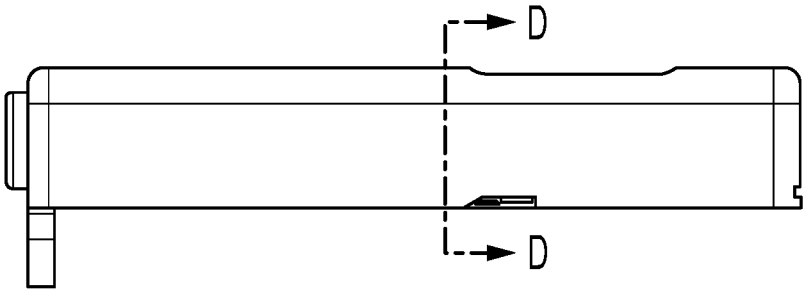
Figure 8C:
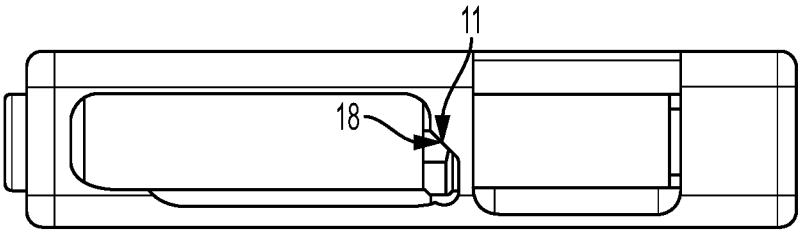
Figure 8D:
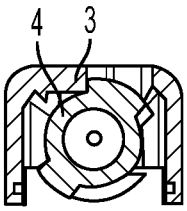

The final rotational position is illustrated in FIG. 5 (somewhat after FIG. 4 in time): the two locking studs 6 have not only completely come out of the locking grooves of the slide 3, but now lie in the region of longitudinal guides 19 which are formed on the slide 3, as can readily be seen in FIGS. 4*f*, 5*d* and 6*d*. During the further axial movement, now of slide and barrel separately, the angular position is thus secured with play (at maximum 8°, preferably at maximum approximately 5°, particularly preferably at maximum 4°) about the bore axis.

It should also be noted that the lateral surface of the control stud 8 (parallel to the bore axis 10), by means of the contact of which with the lateral surface of the control groove 9 the rotational movement of the barrel 4 is ended, leads to a flat contact and therefore creates stable mechanical relationships. Furthermore, it should be pointed out that, in this position, the front surface of the control stud 8, which surface runs normally to the bore axis 10, is at a small distance from the retaining surface 17 (also FIG. 1) which means that the barrel 4 has a certain axial play with respect to the frame 2 in this position.

FIG. 6 shows the temporally following situation with the slide 3 moved back as far as possible at the end of the barrel recoil: The barrel 4 is fixed with respect to the frame 2 (with the play mentioned) by the control stud 8 and the control groove 9 while the slide 3 is brought further rearwards into its rearmost position, by the pressure of the explosion gases and the initial impulse brought about in this manner and also the inertia: the barrel 4 protrudes for a distance out of the slide 3 in the axial direction. FIG. 7 shows the same situation as FIG. 6, only at the beginning of the forward motion of the slide 3; otherwise, nothing additional can be said in this respect.

Subsequently, the slide 3 is fetched forward again by the restoring spring 5 (FIG. 15), wherein the movements proceed as explained below until the situation illustrated in FIG. 1 is finally reached again.

FIGS. 8*a*-8*d* show the engagement, the slide has already passed to the front for a distance in comparison to FIG. 7 and the rotational movement of the barrel 4, as 8*d* shows, has just begun:

A special characteristic of the invention consists here in that, during the forward motion of the slide (when a cartridge is supplied), the control stud 8 of the barrel 4 is pressed onto the retaining surface 17 of the control groove 9 (in the frame 2), which retaining surface runs normally to the bore axis 10, as a result of which the rotational movement of the barrel 4 does not take place by means of this cooperation which is affected by tolerances, but rather is introduced by the interaction of the contact surface 18 of the associated locking stud 6 of the barrel 4 with the guide-rail-like stop surface 11 (see in particular in FIG. 8*c* and FIG. 13*b*) in the slide 3.

Figure 13A:
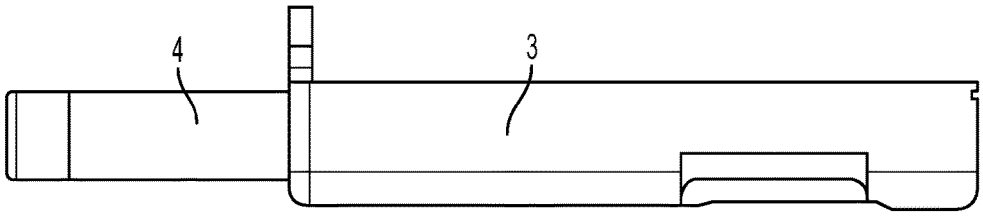
FIGS. 13A-13C depict the assembly of the disclosed embodiment, with the barrel pivoted into an operational position.
Figure 13B:
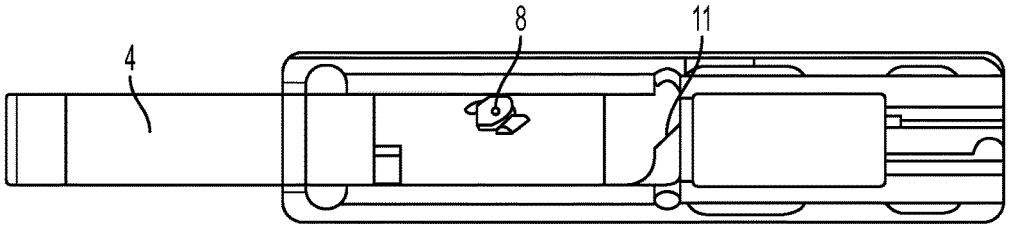

FIG. 13*b*, a bottom view of the slide 3 with the barrel 4 only partially inserted, shows the stop surface 11 of the slide in its entirety. It is designed on the inner surface of the upper wall of the slide as an elevation, therefore projecting inward toward the bore axis 10, and interacts with the locking stud 6 protruding upward in the various "d" illustrations.

The beginning of the rotational movement of the barrel is therefore brought about by this control surface, the stop surface 11, which is located substantially more precisely with respect to the barrel than every possible component which would be provided fixedly on the frame 2. For this reason and by means of the matching of the shape of the associated locking stud 6 to the shape of the stop surface 11, a reliable and mechanically stable guide is produced which does not show any noticeable wear over the service life of the weapon.

This particular shape of the associated locking stud 6 consists substantially in that the end surface which is at the front in the direction of rotation, the contact surface 18, coincides in its inclination with respect to the bore axis with the inclination of the stop surface 11, and therefore a flat contact connection occurs. The static pressures and the dynamic loadings are therefore reduced by orders of magnitude in comparison to those which occur in the prior art.

During the forward motion, the introduction of the rotation therefore takes place via a flat contact connection of components which are provided and guided with low tolerances with respect to one another, and not via a linear contact between components which are guided highly imprecisely with respect to one another and essentially only indirectly, via the slide 3, as is the case in the prior art.

Only after this introduction of the rotational movement does the further and complete locking of the barrel in the slide take place by means of the control stud 8 in interaction with the control groove 9 in the frame 2, as emerges from FIG. 10.

After this complete locking, the two components, slide 3 and barrel 4, run forward together and already locked to each other over the short axial distance (already mentioned above) in the control groove 9 in the direction of the bore axis 10 on the frame 2, as illustrated in FIG. 11.

By means of the initiation according to the invention of the beginning of the locking of the barrel by introduction of the rotational movement not by means of the control stud 8

(control cam) in interaction with the frame 2, but rather by the contact surface 18 and a striking surface, the stop surface 11, between slide and barrel, this movement is completely defined and, as appropriate to the circumstances, is initiated in a shock-free manner and by means of flat contact. Furthermore, the relationship between control stud and control groove is designed to be mechanically substantially more compatible than is possible in the prior art and thus ensures the long service life which up to now has not been achieved in the case of pistols with a rotary barrel.

A refinement of the invention that further increases the mechanical stability is apparent from looking at the individual "d" illustrations together: the slide 3 has a shape in the axial direction between the locking grooves 7 and the breech face 13 (FIG. 15), preferably adjacent to the locking grooves 7, which shape surrounds the barrel beyond its diameter and thus together with the retaining opening 14 for the barrel in the front end surface of the slide, constitutes a form-fitting guide for the barrel 4 in the axial direction (albeit with a noticeable degree of play in the region of a deviation of 0.05 to 0.1 mm from the ideal position in each direction). The correct relative position of the contact surfaces of the locking stud 6 and the stop surface 11 is therefore ensured in the best possible way, as is the quiet movement of the slide and of the barrel during the firing of a shot.

Figure 9A:
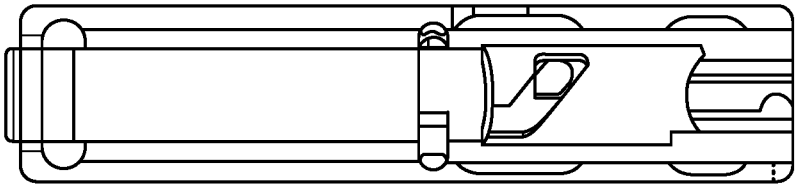
FIGS. 9A-9D depict the end of the engagement for the embodiment of FIGS. 1A-1D.
Figure 9B:
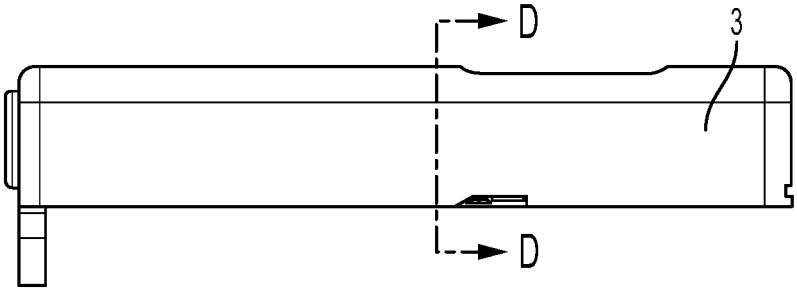
Figure 9C:
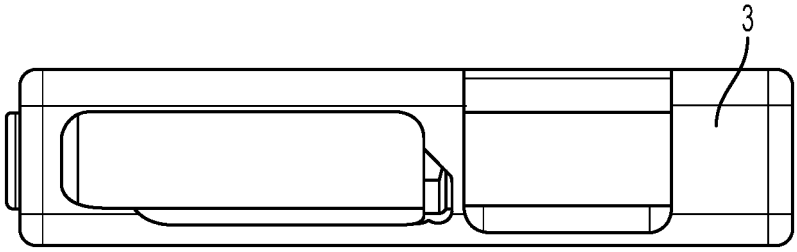
Figure 9D:
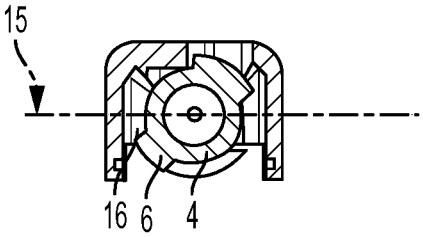
Figure 10A:
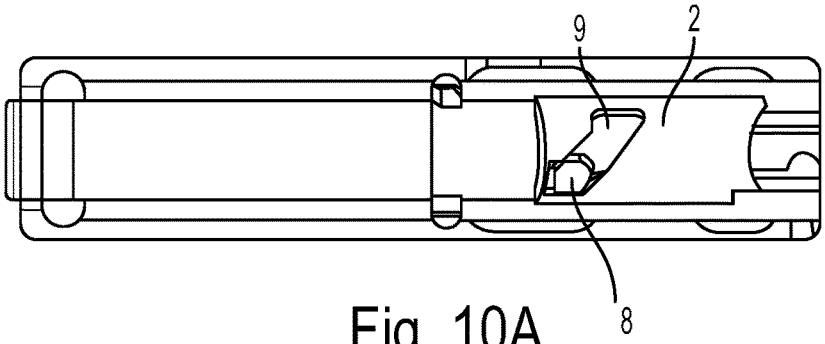
FIGS. 10A-10D depict the rotation of the barrel for the embodiment of FIGS. 1A-1D.
Figure 10B:
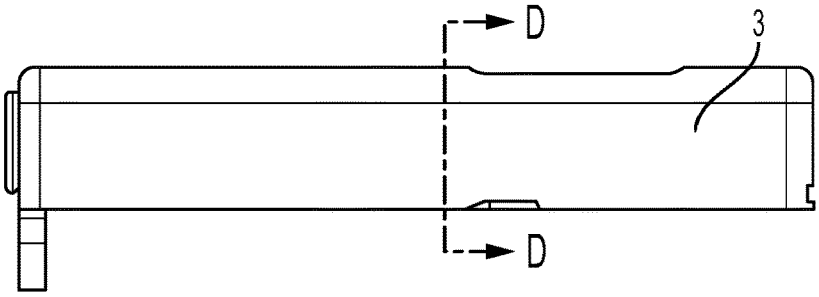
Figure 10C:
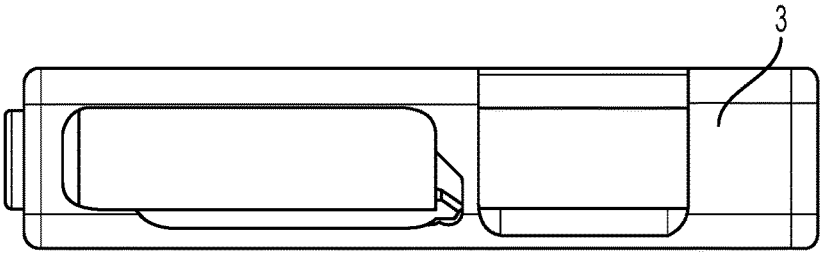
Figure 10D:
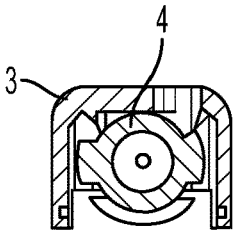
Figure 11A:
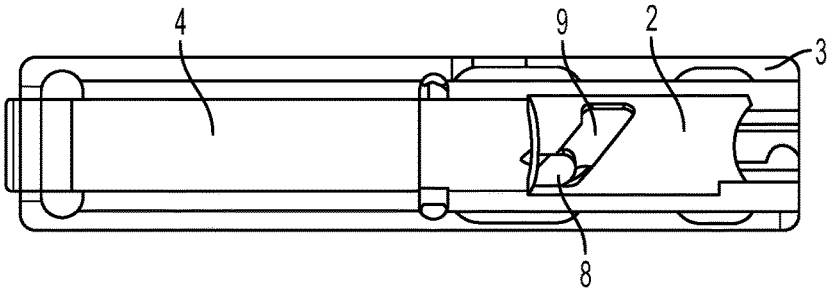
FIGS. 11A-11D depict the final rotation-free forward motion for the embodiment of FIGS. 1A-1D.
Figure 11B:
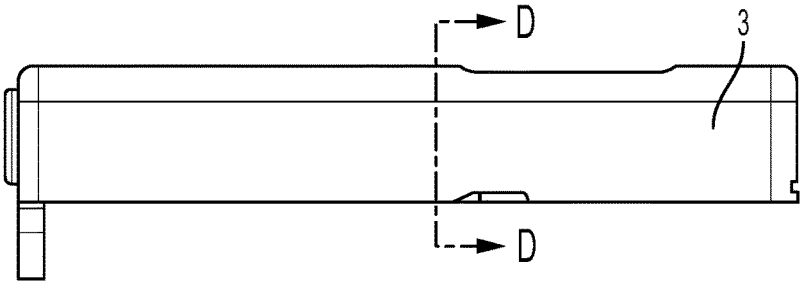
Figure 11C:
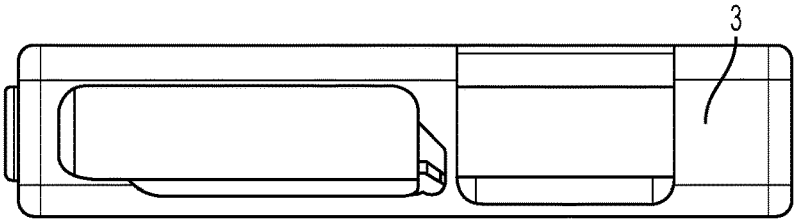
Figure 11D:
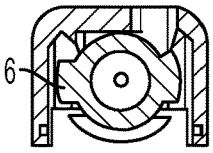
Figure 12B:
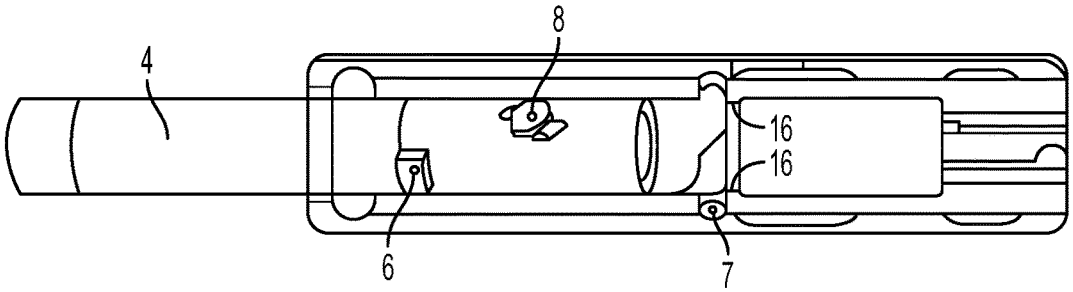
Figure 13C:
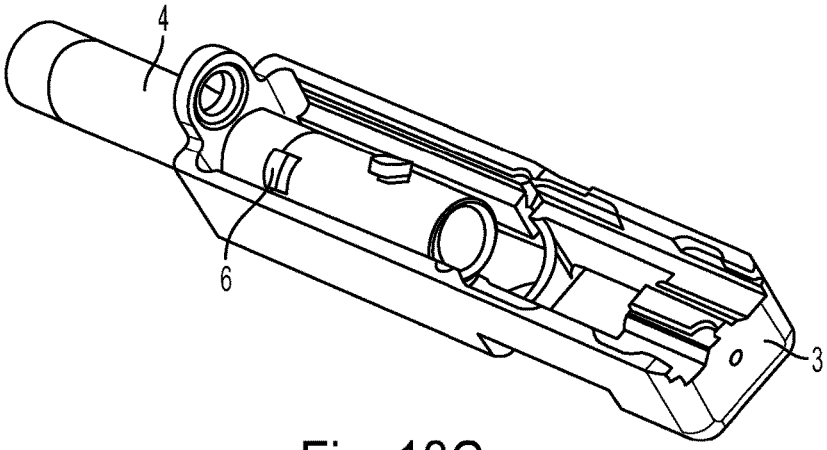

FIG. 13 specifically shows the design of the slide 3 in a circular shape with enveloping surfaces 16 which run beyond the axial plane 15 (virtual equator plane), as a result of which the barrel 4 is prevented from dropping; only the axial displacement and the rotation about the bore axis 10 are permitted by these hollow-cylindrical enveloping surfaces 16 (FIG. 12*b* and, without reference sign, FIG. 9*d*) of the slide.

Figure 12A:
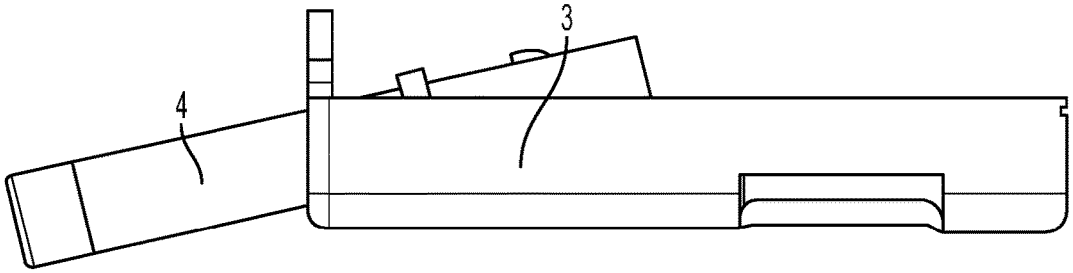
FIGS. 12A-12C depict the assembly of the barrel with the slide of the disclosed embodiment.
Figure 12C:
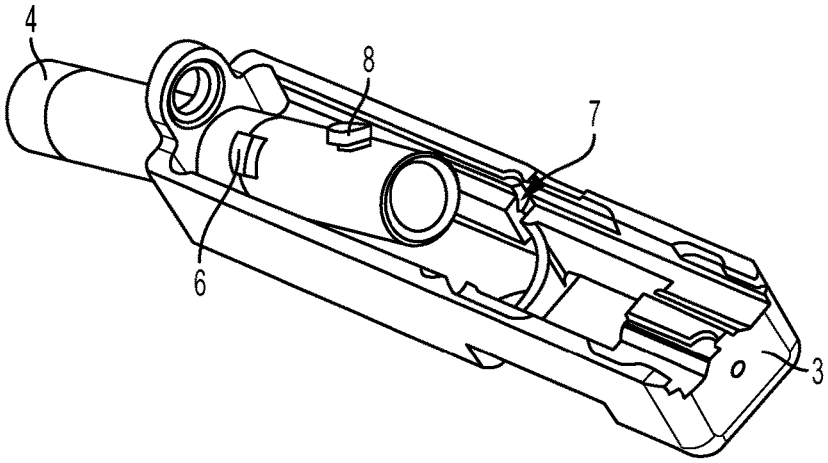
Figure 14A:
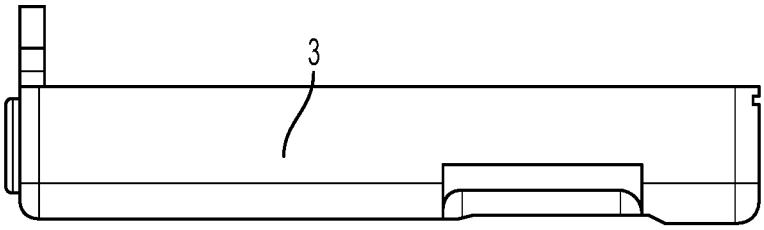
FIGS. 14A-14C depict the assembly of the disclosed embodiment, with the barrel displaced rearward toward the breech face.
Figure 14B:
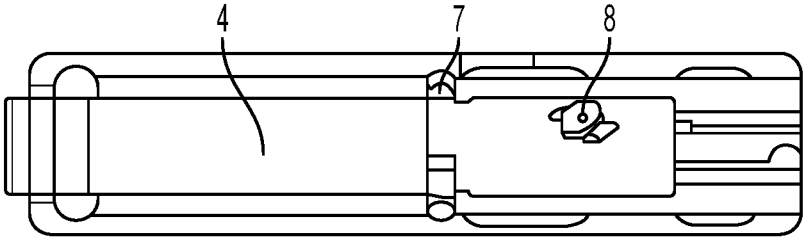
Figure 14C:
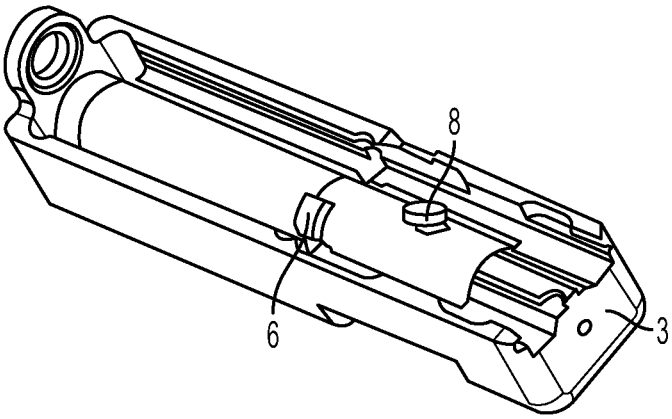

The assembly of such a slide is clear from FIGS. 12 to 14, wherein, for clarity reasons, the restoring spring 5 is not illustrated: the barrel 4 is plugged at its front end through the retaining opening 14 of the slide and pushed obliquely forward until its rearward end comes to lie in front of the enveloping surfaces 16. In the process, the barrel is rotated in such a manner that the locking stud which bears the contact surface for the rotational movement protrudes away from the frame and lies virtually in the center plane of the weapon. In this position, as FIG. 13 shows, the barrel can be pivoted into its operational position and, in this position, the barrel can be displaced rearward, toward the breech face, as a result of which its rear portion (which, however, is at the front during this movement!) comes into the region of the enveloping surfaces 16 and is thus guided, as described above. FIG. 14 shows the end position in which the contact surfaces (not visible here) on stud and slide have already carried out the initiation of the rotation, and locking studs and locking grooves are opposite one another.

The invention is not restricted to the exemplary embodiment illustrated and described, but rather may be modified in different ways. It is thus possible to provide the studs and grooves with a different shape and/or dimension, and the position thereof with respect to the frame, the slide and the barrel may be different than illustrated.

An essential factor during the forward motion is that the beginning of the rotational movement of the barrel with respect to the slide takes place by means of the contact of a stop surface located on the breech, on the one hand, and a mating surface located on the barrel, on the other hand. One of the surfaces here is preferably, but not necessarily, provided on one of the locking studs since the latter have to be present in any case. Simply because of a symmetrical introduction of force, the surface on the slide is preferably arranged in the region which lies opposite the frame and therefore substantially in the plane of symmetry of the weapon in the upper, inner wall region of the slide.

The guidance of the barrel by means of the longitudinal guides 19 is also designed in such a manner that said longitudinal guides do not interact with the two locking studs, but rather with one of the locking studs and the control stud.

The materials to be used are the same as in customary weapons and do not require any further explanation here, likewise the production methods and other technological details.

In summary, it can therefore be stipulated that the invention relates to a pistol 1 with a frame 2, a slide 3 which is movable thereon and a rotary barrel 4 which is located in the slide. The rotary barrel is rotated and is moved axially with respect to the slide between a locked position and an open position by means of cams and grooves.

In order to avoid the wear which is customary in weapons of this type, it is provided that the slide 3 has a stop surface 11 running obliquely with respect to the bore axis, and the barrel has a corresponding contact surface 18. During the locking by the flat contact between said surfaces 11, 18, the beginning of the relative rotational movement is thus initiated.

LIST OF REFERENCE SIGNS

01 Weapon
02 Frame
03 Slide (carriage)
04 Barrel
05 Restoring spring
06 Locking stud(s)
07 Locking groove(s)
08 Control stud
09 Control groove
10 Bore axis
11 Stop surface
12 Control surface edge
13 Breech face
14 Retaining opening
15 Equator plane
16 Enveloping surface(s)
17 Retaining surface
18 Contact surface
19 Longitudinal guides

What is claimed:

1. A pistol, comprising:

a frame;

a slide which is movable on the frame; and a rotary barrel which is located in the slide and configured to be in a locked position or an open position, where the rotary barrel has a bore axis and a contact surface;

wherein the slide has a stop surface running obliquely with respect to the bore axis of the rotary barrel, and the stop surface of the slide and the contact surface of the rotary barrel are configured to come into flat contact to initiate a rotational movement of the barrel relative to the slide; and wherein the rotary barrel is configured to be rotated and moved axially with respect to the slide between the locked position and the open position by the cooperation of cams and grooves.

2. The pistol according to claim 1, wherein when the barrel is in the locked position the flat contact between the contact surface of the barrel and the stop surface of the slide initiates the rotational movement of the barrel relative to the slide.

3. The pistol according to claim 1, wherein the contact surface of the barrel is disposed on at least one cam that is a locking stud configured to interact with at least one locking groove of the slide.

4. The pistol according to claim 1, wherein the contact surface of the barrel is provided on a dedicated cam.

5. The pistol according to claim 1, wherein the stop surface on the slide is provided in a region of the slide that lies opposite the frame with respect to the bore axis.

6. The pistol according to claim 1, wherein the barrel includes plural projections, and the slide includes a plurality of strip-shaped longitudinal guides that are parallel to the bore axis and configured so that when the barrel is in the open position the strip-shaped longitudinal guides interact with the projections of the barrel to fix the angular position of the barrel to within 8°.

7. The pistol according to claim 6, wherein the strip-shaped longitudinal guides interact with the projections of the barrel to fix the angular position of the barrel to within 4°.

8. The pistol according to claim 6, wherein at least one of the projections of the barrel is a locking stud.

9. The pistol according to claim 1, wherein the slide includes one or more enveloping surfaces configured to guide the barrel in an axially displaceable and rotatable, but captive manner.

10. The pistol according to claim 9, wherein the enveloping surfaces guide the barrel by surrounding the barrel beyond a center plane thereof.

11. The pistol according to claim 9, wherein the slide has a breech face, and the enveloping surfaces are provided in a region between the at least one locking groove for the locking studs and the breech face.

* * * * *